United States Patent [19]

Schwarz

[11] 4,381,841

[45] May 3, 1983

[54] INTERLOCKING ARRANGEMENT FOR PLASTIC CONTAINERS

[75] Inventor: Howard H. Schwarz, Moorestown, N.J.

[73] Assignee: Contour Packaging Corporation, Philadelphia, Pa.

[21] Appl. No.: 319,380

[22] Filed: Nov. 9, 1981

[51] Int. Cl.[3] ..... B65D 25/08; B65D 21/02

[52] U.S. Cl. ..... 220/23.4; 206/504; 215/10

[58] Field of Search ..... 220/23.4; 206/504; 215/10

[56] References Cited

U.S. PATENT DOCUMENTS

| | | | |
|---|---|---|---|
| 3,194,426 | 7/1965 | Brown, Jr. . | |
| 3,225,951 | 12/1965 | Poston et al. . | |
| 3,658,204 | 4/1972 | Bottger | 220/23.4 |
| 3,857,482 | 12/1974 | Shelton | 220/23.4 |
| 4,103,358 | 7/1978 | Gacki et al. . | |
| 4,165,812 | 8/1979 | Jennison . | |
| 4,216,857 | 8/1980 | Huang | 206/504 |
| 4,271,965 | 6/1981 | Branbly | 206/219 |

FOREIGN PATENT DOCUMENTS

| | | | |
|---|---|---|---|
| 1133819 | 11/1968 | United Kingdom | 220/23.4 |

*Primary Examiner*—George E. Lowrance
*Attorney, Agent, or Firm*—Paul & Paul

[57] ABSTRACT

An interlocking arrangement for plastic containers is disclosed, which is particularly suitable for use in a container system for storing and dispensing film-processing chemicals. The interlock arrangement comprises two sections, a curved protrusion, and a tapered flange, the protrusion being located near one end of the flange. The interlock, which has both male and female portions, is integrally formed with the plastic container with which it is associated. The interlock tends to prevent containers from accidentally separating during transportation and handling.

4 Claims, 5 Drawing Figures

INTERLOCKING ARRANGEMENT FOR PLASTIC CONTAINERS

BACKGROUND OF THE INVENTION

This invention discloses an interlocking arrangement which can be used to secure plastic containers to each other. The invention is especially suitable for use with container systems for storing and dispensing film-processing chemicals.

Examples of the container systems in which the present invention can be used are found in U.S. Pat. No. 4,103,358, entitled "Fluid Mixing and Dispensing System" and U.S. Pat. application Ser. No. 929,174, filed July 25, 1978, entitled "Container for Film Processing Chemicals." Both the patent and the application cited above are incorporated by reference herein.

In container systems such as are described in the references cited, and particularly in the latter reference, there are provided a plurality of plastic containers having predetermined volumes, each container being distinct, and being designed to hold a particular chemical used in film processing. The container is intended to be inverted, and inserted into an appropriate receptacle in or over a film developing machine, so that the chemicals from the containers can flow directly into the appropriate storage tanks within the machine. Such a receptacle may consist of nothing more than a plurality of openings, through which chemicals are to be poured, or the receptacle could also be recessed, allowing the inverted container to be left in the machine while the chemicals are being poured out. The advantage of the container system of this type is that the proper chemicals, in the precise proportions, can be supplied to the machine, without the need to measure the amounts of the chemicals, and without the need to be concerned with which openings on the developing machine should receive which chemicals. Typically, the container system has indentations which correspond to protrusions in the receptacle portion of the developing machine, so that the container system can be inserted into the machine in only one way. This arrangement insures that the proper chemicals will be directed to the proper storage tanks.

In practice, it is often the case that the container system used for storing and dispensing film-processing chemicals comprises one large vessel, and at least two small containers which are designed to snap onto the larger vessel. In the prior art, the means for attaching the small plastic container to the large plastic vessel has been by using a mortise and tenon combination. However, this structure has proved unreliable, because during handling and transportation, the small containers are likely to separate from the large vessel.

The present invention solves the problem described above by providing a unique interlocking arrangement which prevents the small plastic container from disengaging from the larger plastic vessel. Although the invention is described with respect to one particular field of use, namely the storage and handling of film processing chemicals, it is understood that the interlocking arrangement could be used to hold plastic containers together in other contexts.

SUMMARY OF THE INVENTION

The interlocking arrangement of the present invention comprises male and female portions, each portion being integrally formed with a plastic container. The male portion comprises a curved protrusion and a tapered flange, the protrusion being located near one end of the flange. The female portion is disposed on (and defined by) the other plastic container, to receive the male portion when the containers are joined. The female portion thus comprises recesses shaped to corresond with the protrusion and flange of the male portion.

The tapered flange of the male portion is shaped so that its width increases with distance from the container. The curved protrusion of the male portion slightly overhangs the tapered flange. These features tend to prevent the containers from spontaneously separating from each other during transportation or handling.

Accordingly, it is a primary object of the present invention to provide an interlocking arrangement for plastic containers, which arrangement tends to prevent the containers from separating from each other during transportation or handling.

It is a further object of the present invention to provide interlocks for plastic containers which can be integrally formed with the containers.

It is a further object of the present invention to provide an interlocking arrangement which can be used to join the components of a container system which is used for storing and dispensing film processing chemicals.

It is a further object of the present invention to provide plastic containers having interlocks, which interlocks can be formed from a mold, and wherein the containers can be easily removed from the mold.

Other objects and advantages of the present invention will be apparent to those skilled in the art from a reading of the following brief description of the drawings, the detailed description of the invention, and the appended claims.

DETAILED DESCRIPTION OF THE INVENTION

Figure 1:
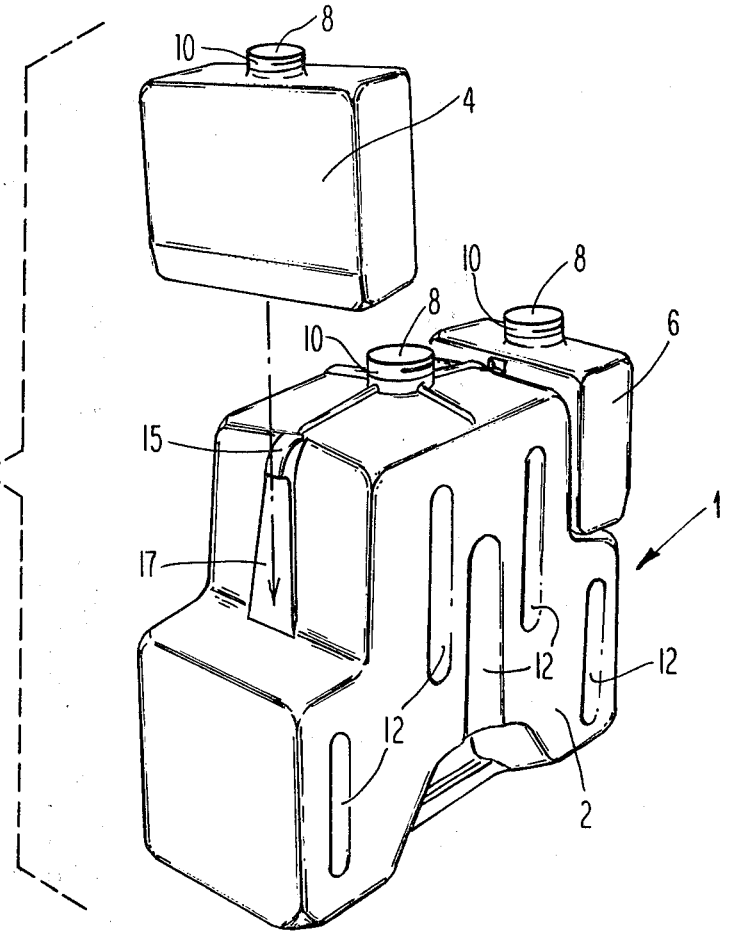
FIG. 1 is a partially exploded perspective view of a container system having the interlock which is the subject of the present invention.

An illustration of the use of the present invention is shown in FIG. 1. FIG. 1 shows a container system designated generally by reference numeral 1 which comprises a large plastic container 2 and small plastic containers 4 and 6. These three containers are of predetermined volumes; when the containers are filled, the container system illustrated in FIG. 1 could hold three different film-processing chemicals in the desired relative proportions. The container system 1 is designed to work in conjunction with film processing machinery, not shown. The containers 2, 4, and 6 would be filled through openings 8, the openings being surrounded by threaded necks 10. When the containers are filled, the container system, as a whole, may be inverted over the appropriate part of the film processing machine, which machine would have openings, or intake holes, spaced to coincide with the relative positions of the openings 8. Thus, the container system 1 could be used to refill simultaneously three tanks within the film processing machine.

The film processing machine (not shown) could also have a recess designed to accommodate the container system 1. In that case, indentations 12 on the container system would mate with suitable protrusions within the recess of the film processing machine. The indentations 12 would thus prevent the operator of the system from putting the container system 1 into the machine in the wrong position. If the container were inserted incorrectly into the machine, then the various storage tanks would receive the wrong chemicals.

In the partially exploded perspective view of FIG. 1, the small container 4 is shown removed from the large container 2. During transportation or handling of the system shown in FIG. 1, it is important that the small containers 4 and 6 not disengage from the large container 2. It is therefore important to provide an interlocking arrangement which avoids such disengagement.

The interlock according to the present invention comprises a male portion and a female portion, both portions being integrally formed with their respective plastic container. Only a male portion is visible in FIG. 1. This portion comprises a curved protrusion 15 and a tapered flange 17. It is seen that protrusion 15 and flange 17 extend from, and are part of, the large container 2. The female portion, not visible in FIG. 1, comprises recesses in small container 4, the recesses being shaped to conform substantially with the protrusion and flange. Of course, container 2 has another male portion (not visible in FIG. 1) which mates with a female portion on container 6.

Figure 2:
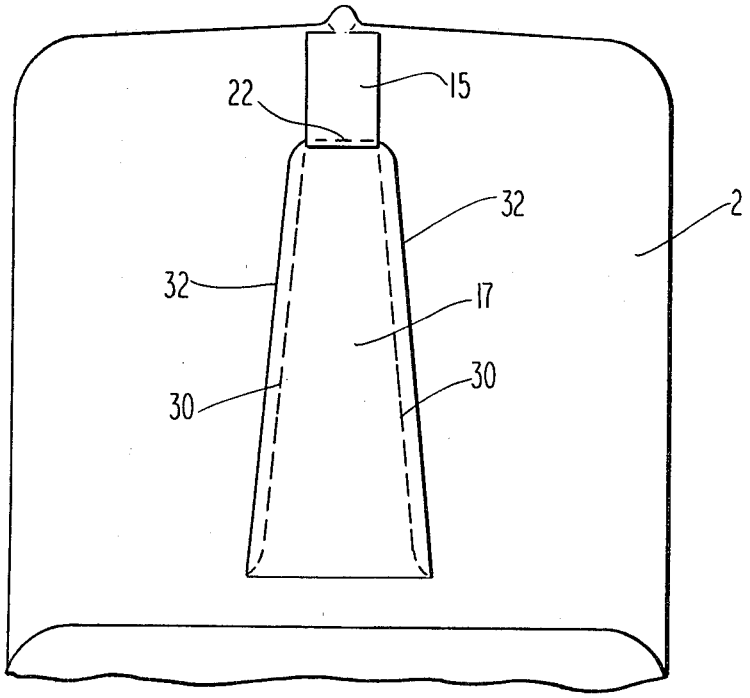
FIG. 2 is a front elevational view of the male portion of the interlock of the present invention.
Figure 4:
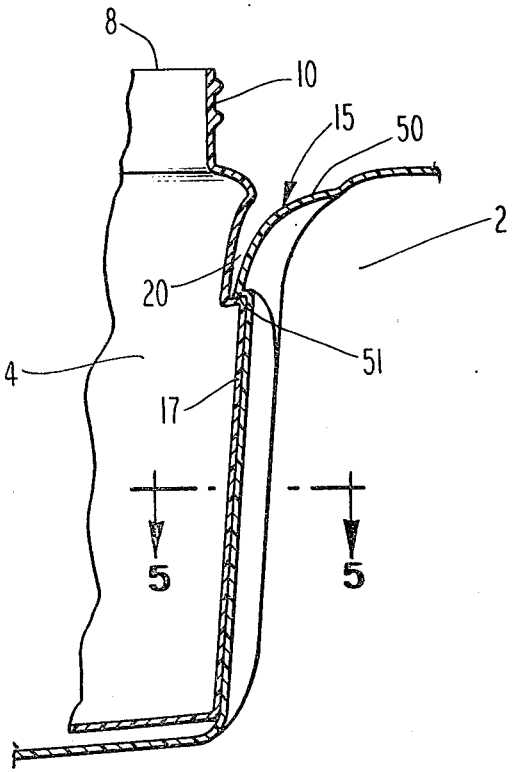
FIG. 4 is a cross-sectional view showing two plastic containers joined together by the interlock of the present invention.
Figure 5:
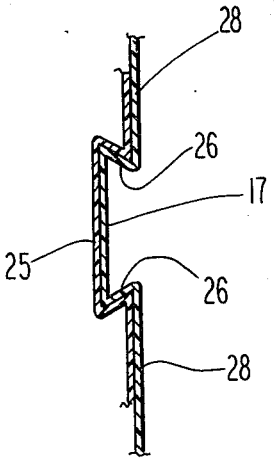
FIG. 5 is a cross-sectional view taken along the line 5—5 of FIG. 4.

The structure of the interlocking arrangement is most clearly illustrated in FIGS. 4 and 5. FIG. 4 shows, in cross section, large container 2 and small container 4 in interlocking relationship. Curved protrusion 15 is seen inserted into corresponding recess 20. Protrusion 15 comprises a curved surface 50 and a straight surface 51, the surfaces 50 and 51 intersecting at an acute angle. As shown in FIG. 4, straight surface 51 has less area than does curved surface 50. The surfaces 50 and 51 intersect along a line which is near one end of flange 17. Protrusion 15 overhangs the tapered flange 17, in such a manner that if force is applied in the horizontal direction in FIG. 4, the plastic containers will tend not to be pulled apart. This overhanging relationship is illustrated also in FIG. 2, which is an elevational view of the protrusion and flange of the male portion on the large container 2. As shown in FIG. 2, protrusion 15 extends below the top boundary of the flange 17, that boundary being indicated by dotted line 22.

The construction of tapered flange 17 is illustrated in FIGS. 2 and 5. FIG. 2 shows the width of the flange increasing in the downward direction. In FIG. 5, tapered flange 17 is shown in engagement with corresponding recess 25 in small container 4. As illustrated in FIGS. 1 and 2, flange 17 has a width which varies continuously in the longitudinal direction (i.e. the vertical direction as shown in the figures, which is the direction along the length of the flange). FIG. 5 shows that the width of the flange also increases with distance from the body of the large container 2. This feature is due to the fact that flange 17 comprises surfaces 26 which form an acute angle with container walls 28. This interlocking relationship is also shown in FIG. 2. Dotted line 30 indicates the point at which surfaces 26 intersect the wall 28 of the container 2, while solid lines 32 represent the external edges of the flange 17. It is apparent from FIG. 2 that the distance, along the horizontal, between the lines 32, is at all times greater than the distance between the lines 30. The latter feature is also shown in FIG. 5.

The structure of the tapered flange is useful not only for providing additional interlocking capacity, but also for facilitating the fabrication of the container system. In practice, the plastic containers are formed in chilled molds, from heat-softened plastic lowered into them in tubular form, captured, and blown with compressed air through the neck. An undercut in its external surface, as is presented by the edges 44 of the female recesses of FIG. 3, prevents the blown part from being ejected from the mold unless formed over a retractable mold section at that point. The tapered shape of this recess permits ejection after only a short movement of this retractable mold section.

Figure 3:
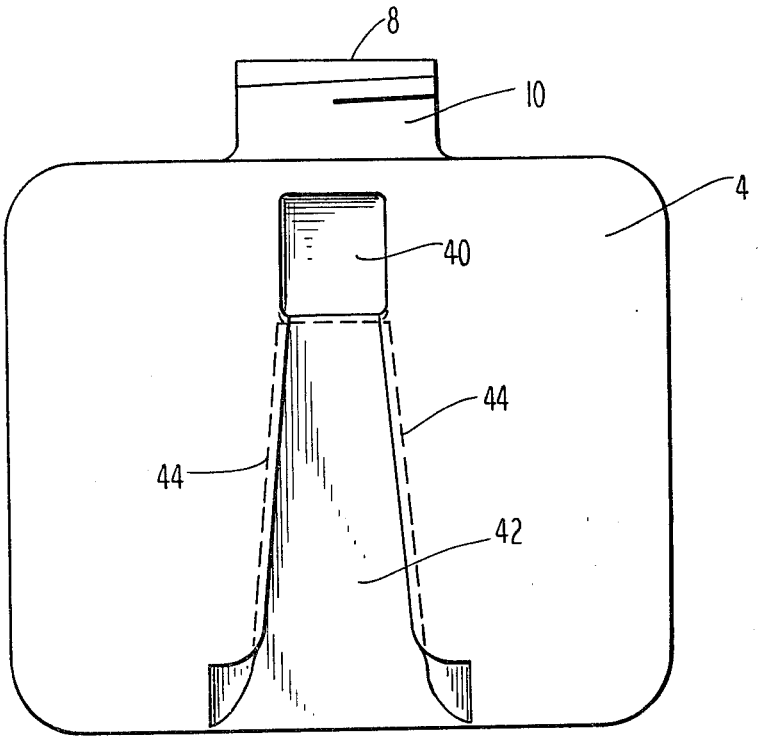
FIG. 3 is a front elevational view of the female portion of the interlock, which, in this figure, is disposed on a small plastic container.

FIG. 3 is an elevational view of the small container 4 (the small container 6 is identical to container 4, in this embodiment). Container 4 defines a female portion of the interlock, the female portion comprising recesses which can mate with the protrusion and flange of a male portion. Curved recess 40 is shaped to coincide with curved protrusion 15, and recess 42 is shaped to coincide with tapered flange 17. The edge of the recess 42, at a point along the body of container 4, is indicated by dotted lines 44, and it is apparent that the width of recess 42 increases as one moves towards the body of container 4. In other words, recess 42 is designed to have a contour which substantially corresponds with that of tapered flange 17.

It is found that plastic containers having the interlock of the present invention can be snapped onto each other easily. The containers tend not to come apart spontaneously, but they will disengage when deliberately pulled.

While the above invention has been described with reference to a container system for storing and dispensing film-processing chemicals, it is understood that the invention has applicability to other fields. Wherever two plastic containers need to be joined, so that they will not spontaneously separate during transportation or handling, the present invention may be used. The precise arrangement of the plastic containers can be varied. The number and relative size of the plastic containers used can be changed. Also, the invention may be used to join plastic members of other kinds, and is not necesarily restricted to use with plastic containers only. Such changes and other modifications apparent to those skilled in the art are to be deemed within the scope of the following claims.

What is claimed is:

1. In a container system comprising a plurality of plastic containers of predetermined volumes, the system being suitable for storing chemicals and pouring said chemicals into a machine, the improvement which comprises:

an interlock for snapping a first of said containers onto a second of said containers, the interlock comprising a male portion disposed on the first container and a female portion disposed on the second container, the female portion having a contour shaped to coincide substantially with the contour of the male portion, each part of the male portion having a counterpart in the female portion, the male portion comprising a curved protrusion and a tapered flange, the protrusion and the flange being adjacent to each other, and wherein the protrusion overhangs the flange, the curved protrusion comprising a curved surface and a straight surface, the surfaces intersecting at an acute angle and along a line spaced sufficiently away from the body of the container such that the curved protrusion can be hooked onto its counterpart in the female portion of the container, the tapered flange having a width which increases with the distance away from the curved protrusion, the width of the flange also increasing with the distance from the container, wherein the tapered flange on the male portion is capable of being snapped onto its counterpart in the female portion of the container, wherein the curved protrusion and the tapered flange are capable of being matably attached to their respective female counterparts.

2. The improvement of claim 1, wherein the male and female portions are integrally formed with their respective containers.

3. The improvement of claim 2, wherein the tapered flange is at least twice as long as any dimension of the curved protrusion.

4. The improvement of claim 3, wherein the flange, at its point of maximum width, is less than one half the width of the container.

* * * * *